US005667407A

United States Patent [19]

Frommer et al.

[11] Patent Number: 5,667,407

[45] Date of Patent: Sep. 16, 1997

[54] SHIELDED CABLE PLUG

[75] Inventors: Juergen Frommer, Fellback; Manfred Illg, Weinstadt; Manfred Schock, Dreieich, all of Germany

[73] Assignee: ITT Corporation, New York, N.Y.

[21] Appl. No.: 584,173

[22] Filed: Jan. 11, 1996

Related U.S. Application Data

[63] Continuation-in-part of PCT/EP95/00387, Feb. 21, 1995

[51] Int. Cl.[6] ..... H01R 9/03

[52] U.S. Cl. ..... 439/610

[58] Field of Search ..... 439/607, 609, 439/610, 98

[56] References Cited

U.S. PATENT DOCUMENTS 4,557,545 12/1985 Ohtuski .
4,653,836 3/1987 Peele .
5,052,949 10/1991 Lopata ..... 439/610
5,073,130 12/1991 Nakamura .
5,244,397 9/1993 Anhalt .

FOREIGN PATENT DOCUMENTS 0573162 12/1993 European Pat. Off. .

*Primary Examiner*—Khiem Nguyen
*Assistant Examiner*—Yong Ki Kim
*Attorney, Agent, or Firm*—Freilich Hornbaker Rosen

[57] ABSTRACT

A cable plug is described for connecting a cable to the rear of an IC (integrated circuit) card of the PCMCIA type, which makes a simple ground connection between the cable shield and the card cover. Case shells (31, 32, FIG. 2 ) of the plug connector have rear ends with a crimp (37) and a bridge (40) that directly engage a cable shield (24). The case shells have front ends that form forwardly-projecting tabs (43, 44). The tabs project through slits (45, 46) of a carrier plate portion (12) and directly engage sheet metal cover portions of the IC card. The tabs lie slightly above and below plug parts (13, 14) of the carrier, so the front parts protect the tabs.

9 Claims, 5 Drawing Sheets

SHIELDED CABLE PLUG

CROSS REFERENCE

This is a continuation-in-part of International Application PCT/EP95/00387 which was filed on Feb. 21, 1995 and which designated the United States.

BACKGROUND OF THE INVENTION

This invention relates to a shielded cable plug for insertion into the rear of an IC (integrated circuit) card, and to the combination of the shielded cable plug and an IC card.

Cable plugs have a row of socket contacts that mate with a row of pin contacts at the rear of an IC (integrated circuit) card. Where the cable plug has a sheet metal shield case, it is common to connect the shield case to one of the socket contacts. At the IC card, one of the pin contacts may be connected to the sheet metal cover of the IC card. To provide such connections between a socket or pin contact and a sheet metal shield at both the cable plug and the IC card involves the provision of additional parts that add to the cost of manufacture and assembly. It would be desirable if the sheet metal of the cable plug and IC card could be connected together, usually to ground them, in as simple and low cost a matter as possible.

SUMMARY OF THE INVENTION

In accordance with one embodiment of the invention, a shielded cable plug is provided, which has a minimum number of parts for electrically connecting a cable shield to a conductive cover of an IC (integrated circuit) card when the cable plug mates with the card. The cable plug includes an insulative carrier with a plate portion and with a pair of plug parts projecting forwardly of the plate portion for insertion into openings at the rear of the IC card. The plug includes a sheet metal case that lies primarily rearward of the carrier plate portion. The sheet metal case has tabs that project forwardly through slits in the plate portion, and which directly engage the sheet metal of the cover of the IC card. The tabs preferably lie above and/or below the plug parts, so the plug parts help protect the tabs from damage.

The novel features of the invention are set forth with particularly in the appended claims. The invention will be best understood from the following description when read in conjunction with the accompanying drawings.

DESCRIPTION OF THE PREFERRED EMBODIMENT

Figure 1A:
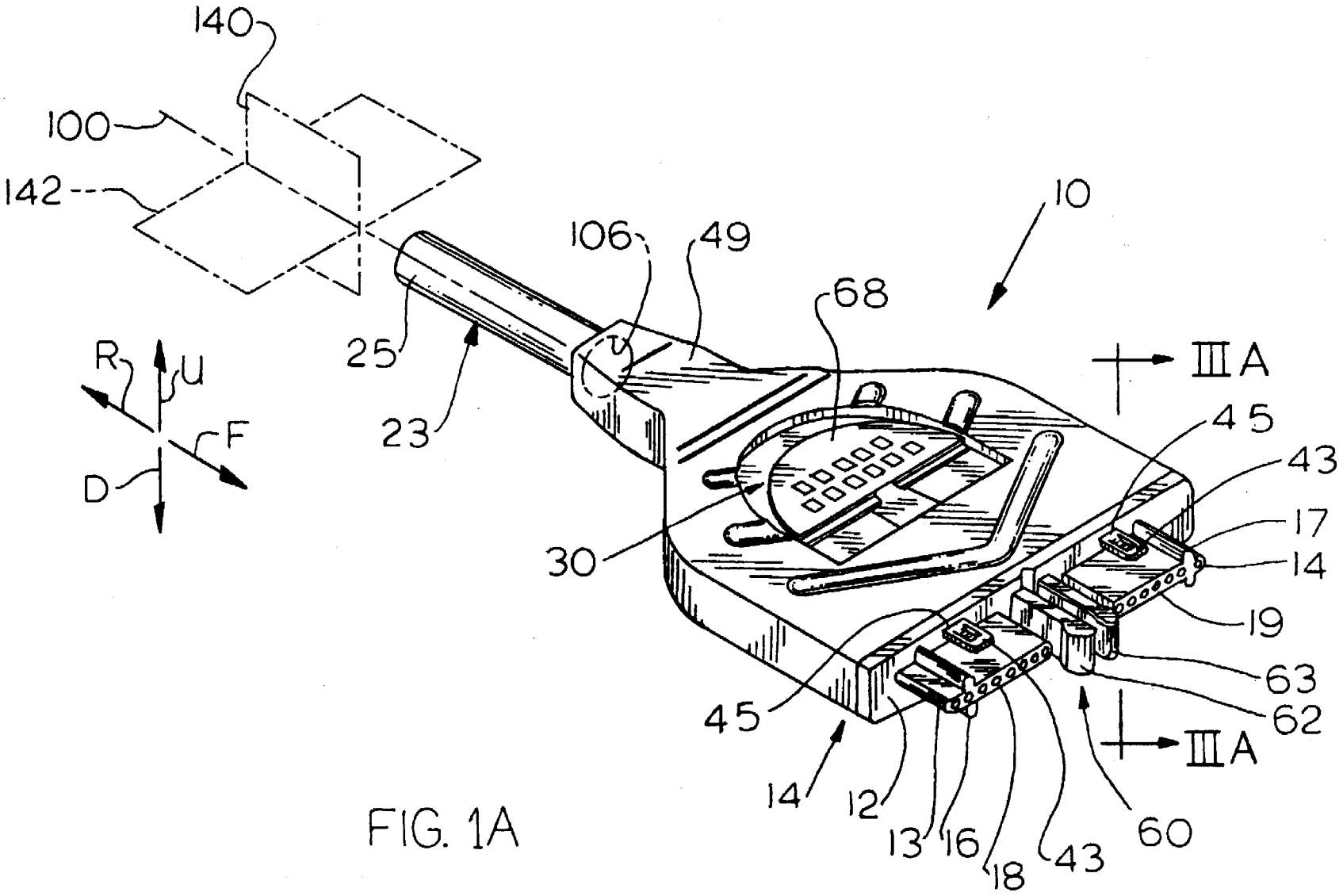
FIG. 1A is an isometric view of a shielded cable plug of the invention, shown connected to a cable.
Figure 1B:
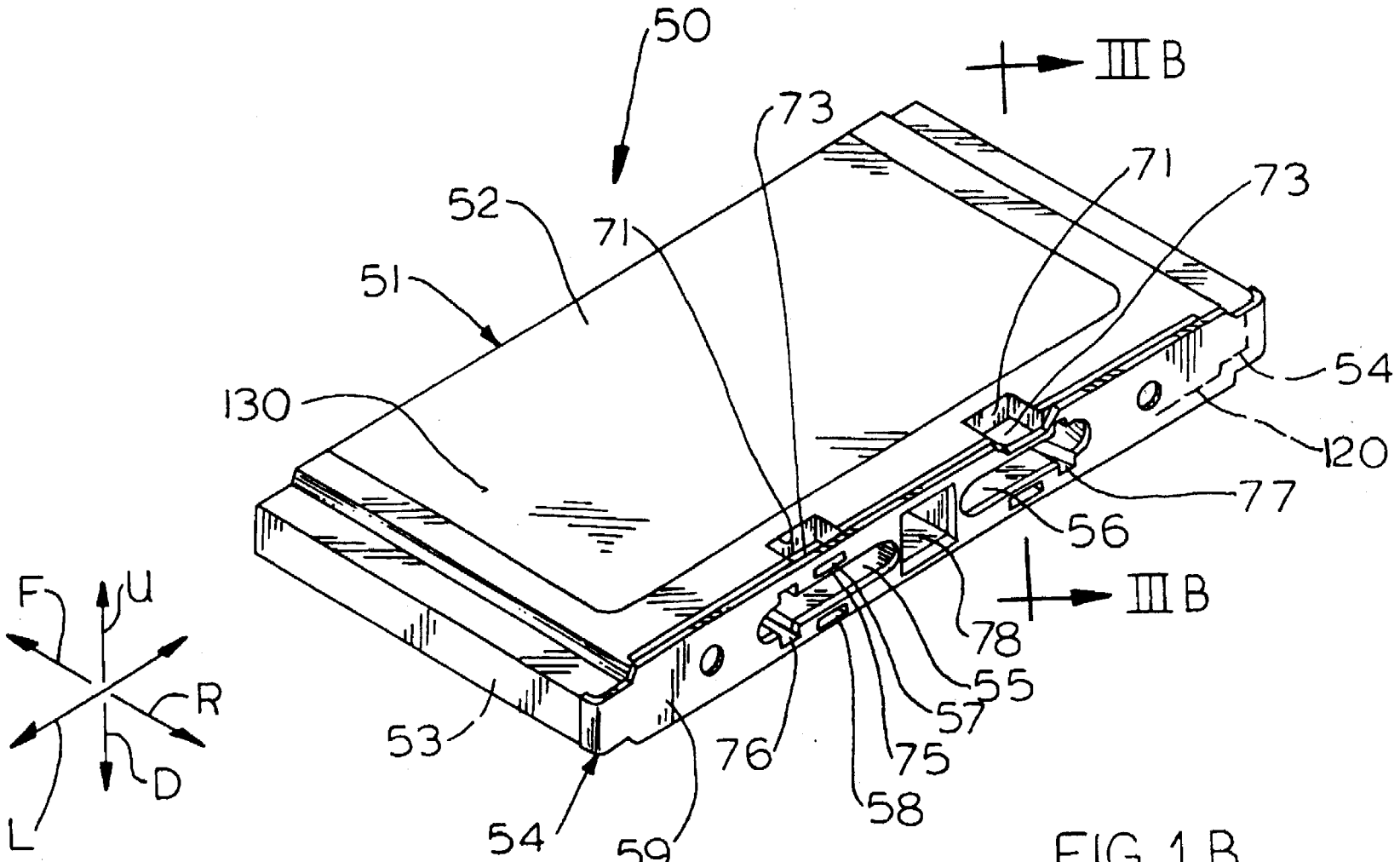
FIG. 1B is a partial isometric view of an IC card that can be mated with the cable plug of FIG. 1A.

FIG. 1A shows a screened, or shielded cable plug 10 that is constructed in accordance with PCMCIA (Personal Computer Memory Card International Association) standards, to connect to the rear of an IC card. Such cards have a width and length of 54 mm and 85.6 mm respectively, with three different types having thicknesses of 3.3 mm, 5 mm and 10.6 mm. The cable plug, which is usually no thicker than the thinnest card, allows connection of the card to a local area network (LAN) or other electronic equipment. FIG. 1B shows the rear portion of a plug-in or IC (integrated circuit) card 50 which can be inserted forwardly (F) into equipment such as a computer.

Figure 2:
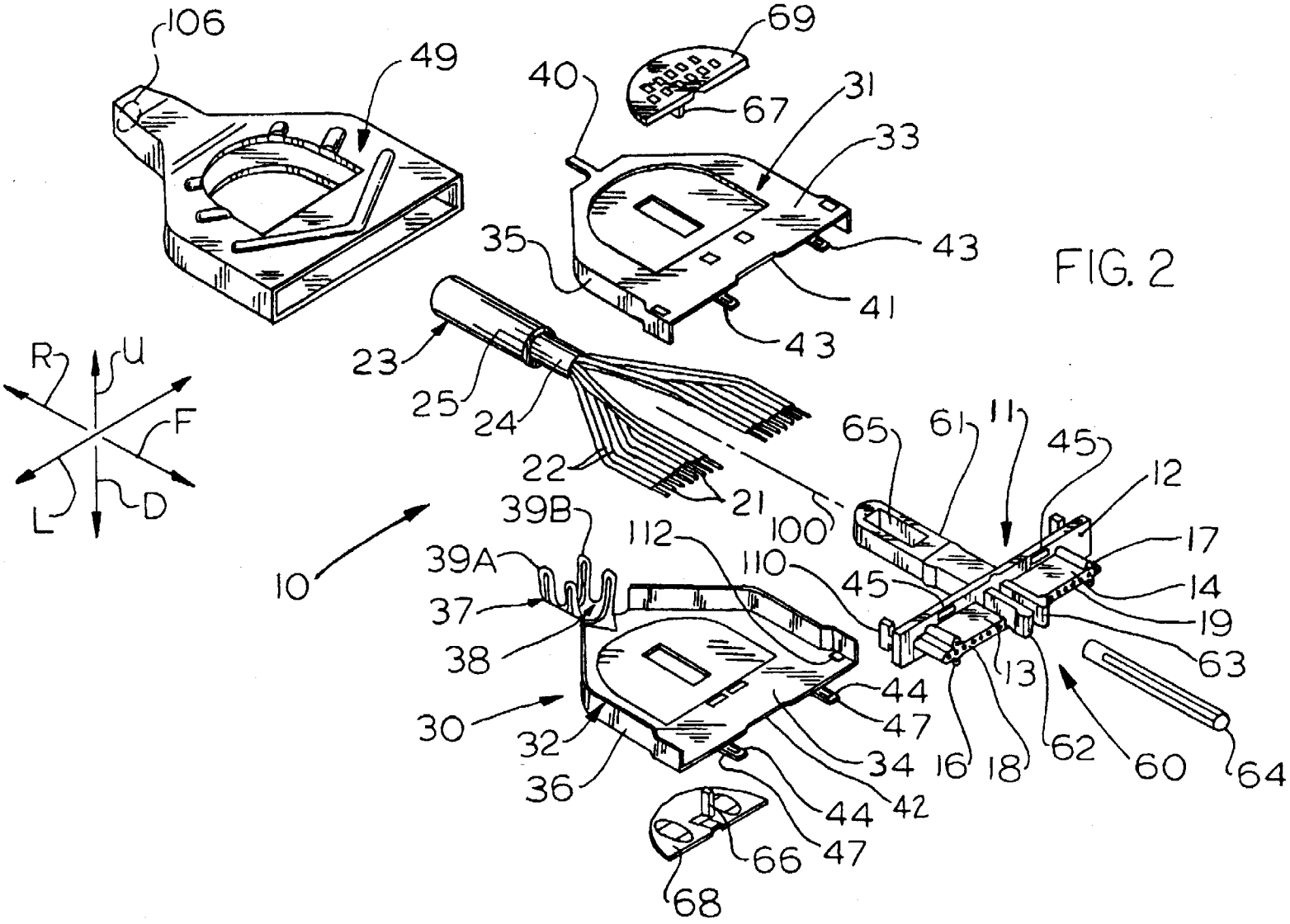
FIG. 2 is an exploded isometric view of the cable plug and a portion of the cable of FIG. 1A.

As shown in FIG. 2, the shielded (against electromagnetic interference) cable plug 10 includes a dielectric (insulative) contact carrier 11. The carrier includes a frame plate or plate portion 12, and a pair of plug-and-socket parts 13, 14 that project forwardly, in direction F, from the plate portion. The plug parts 13, 14 lie on laterally (along direction L) opposite sides of a plug axis 100. The plug parts have staggered keys 16, 17 for one-way-only insertion into the IC card 50. The plug parts have holes 18, 19 that extend through the plate portion 12. The holes 18, 19 hold socket contacts which receive the stripped ends 21 of single wires 22 of a cable 24. Each wire 22 is either soldered or crimped to one of the socket contacts. The cable 23 has a shield 24 which is usually in the form of a wire braiding, and includes an insulative jacket 25 that surrounds the shield.

Figure 5:
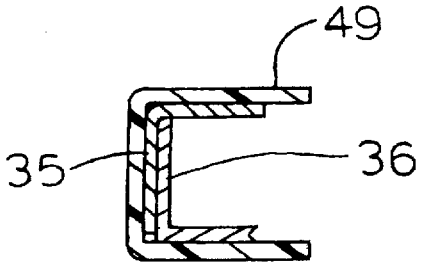
FIG. 5 is a partial sectional view of the cable plug.

The cable plug 10 has a sheet metal shield case 30 which includes upper and lower case shells 31, 32 that are each formed from sheet metal, and have large-area plate parts 33, 34. Each case shell also has folded edges, or vertically-extending sides 35, 36. The upper case sides 35 extend downwardly (D) from opposite sides of the upper plate part 33 while the lower case sides 36 extend upwardly (U) from opposite sides of the lower plate part 34. Each of the case shells has a front end with a lateral (L) width that is slightly less than the width of the carrier plate portion 12. The rear of the plate parts are essentially trapezoidal in shape, while the front parts are largely rectangular. The two case shells 31 and 32 can engage each other by way of their overlapping sides 35, 36, as shown in FIG. 5.

Figure 6:
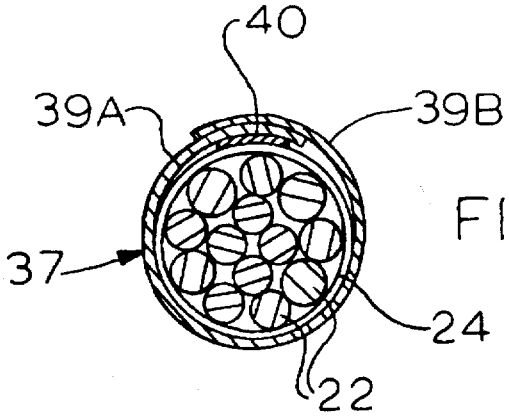
FIG. 6 is a sectional view of the cable and rear end of the shield case, with the cable crimp shown wrapped about the cable and just prior to crimping.

As shown in FIG. 2, the lower case shell 32 has a rear end which forms a cable crimp part 37 in the form of a U-shaped channel 38. The channel forms a pair of sides or fingers 39A, 39B that preferably have slots forming three or four vertically-extending finger parts. The upper case shell 31 has a rearwardly-extending narrow projection forming a bridge 40 that lies between the fingers of the cable crimp part 37. As shown in FIG. 6, the connection between the cable shield 24 and the two case halves is effected by first laying the cable shield in the cable crimp part 37. The bridge 40 is laid on top of the cable shield. Then the fingers such as 39A, 39B are bent to surround the cable shield and the bridge, as shown in FIG. 6. Finally, the crimp part 37 is crimped, such as at two or three locations, to fix the parts together. The crimping also electrically connects the (usually electrically grounded) cable shield 24 to each of the case shells 31, 32, while also fastening the rear ends of the case shells together.

Figure 3:
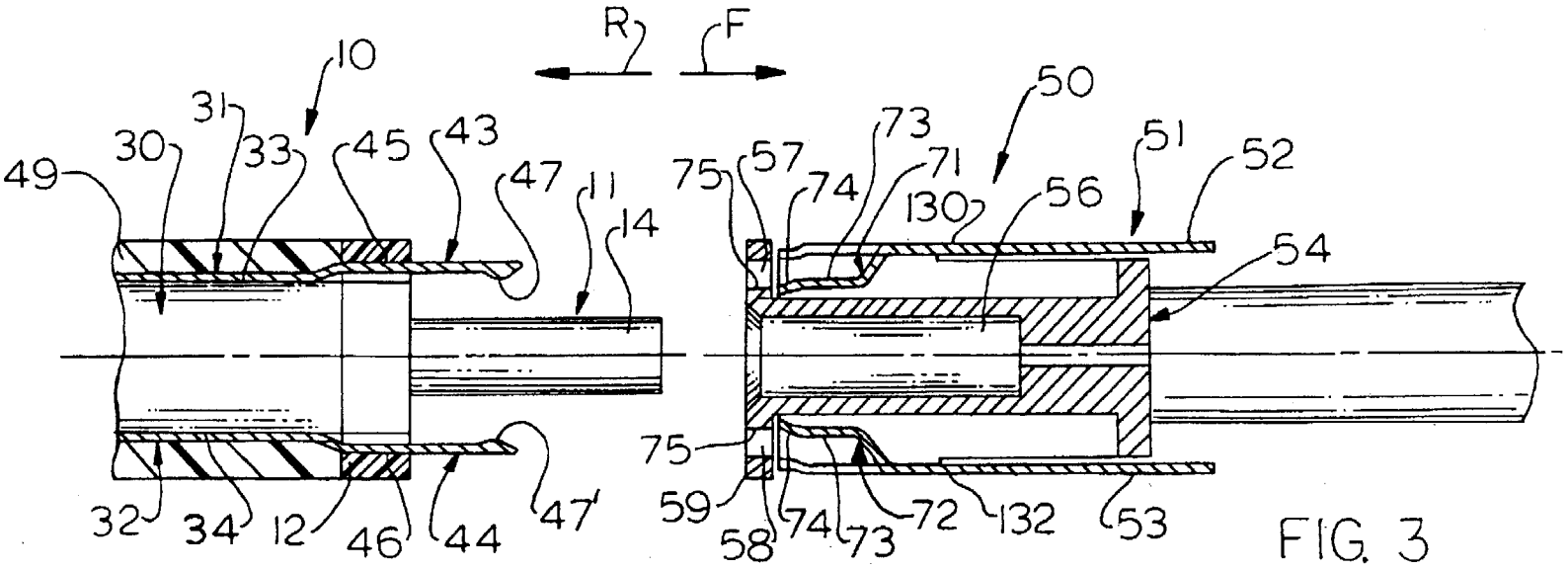
FIG. 3 is an exploded sectional view of a portion of the cable plug as taken on line IIIA—IIIA in FIG. 1A and of a portion of the IC card as taken on line IIIB—IIIB in FIG. 1B.
Figure 4:
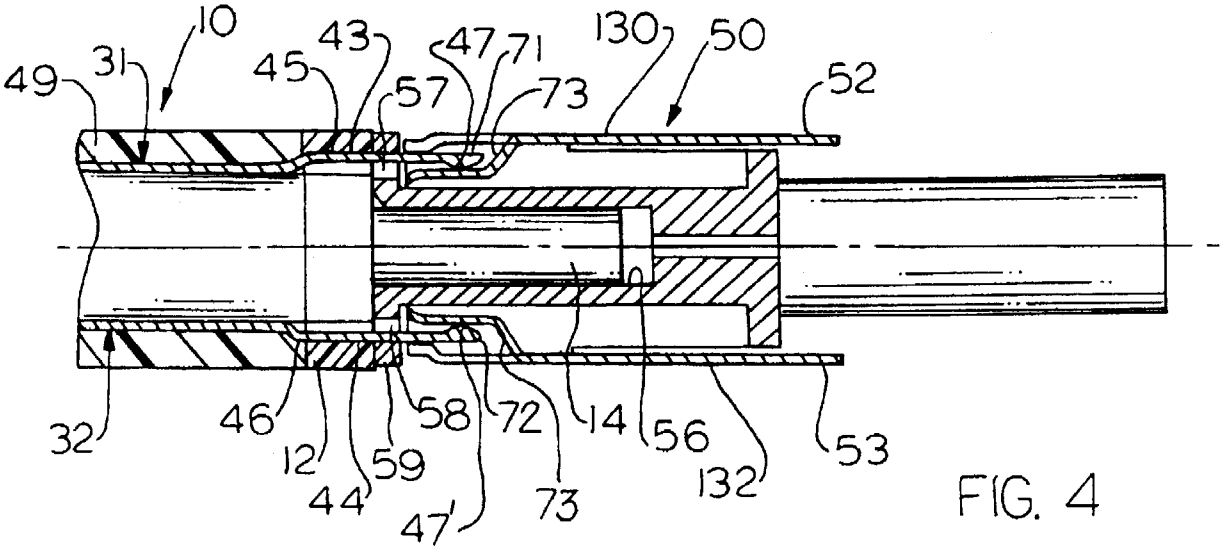
FIG. 4 is a view of the portion of the cable plug and IC card of FIG. 3, with the plug and card fully mated.
Figure 7:
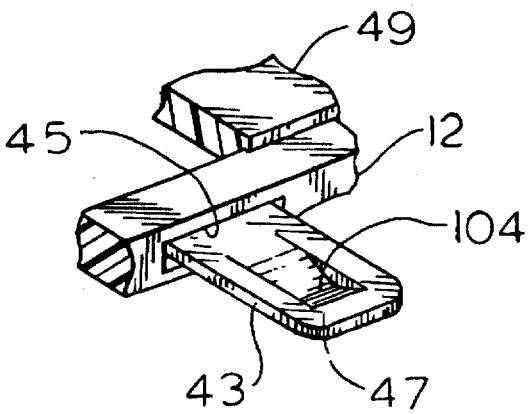
FIG. 7 is an enlarged isometric view of a portion of the cable plug, showing one of the grounding tabs.

The front ends of both case shells 31, 32 are fitted with forwardly-projecting shield contact ties or tabs 43, 44. In the particular cable plug shown, two grounding tabs 43, 44 are provided per case shell 31, 32, with each grounding tab lying equally distant from the plug axis 100. FIGS. 3 and 4 show that the grounding tabs 43, 44 project through passages 45, 46 in the form of slits in the plate portion 12, with the tabs extending forward of the plate portion. The front free ends of the tabs 43, 44 are provided with convex ends 47, 47'. FIG. 7 shows how the bulging parts 104 that form the convex ends are formed from the sheet metal of a case shell.

The slit passages 45, 46 in the plate portion 12, lie respectively above and below the plug parts 13, 14 (FIG. 3). The plug parts thereby help protect the tabs from damage. When the cable plug 10 is assembled, the tabs 43, 44 are inserted through the slits 45, 46. This helps to hold the front ends of the case shells 31 and 32 together. Thus, the cable crimp 37 and the bridge 40 hold the rear ends of the upper and lower case shells together and to the cable, while the tabs 43, 44 hold the front ends of the cable shells together and fix their positions with respect to the contact carrier 11. It may be noted that latches 110 (FIG. 2) on the carrier 11 fit into holes 112 in the case shells, to help fix the carrier to the case.

After the assembly of the shield case 30 to the carrier 11, a protective plug cover 49, which was previously threaded on the cable, is moved forwardly around the case, up to the carrier plate portion 12. The cable extends rearwardly through a passage 106 in the cover. The front of the cover is open and extends along the entire rectangular periphery of the plate portion 12.

FIG. 2 shows that the contact carrier 11 has a locking device 60 which includes a holder 61 extending rearwardly from the plate portion 12. The locking device also includes two latching portions or detent tongues 62, 63 projecting forwardly from the front end of the plate portion 12. The detent tongues 62, 63 are located between the two plug parts 13, 14. The holder 61, tongues 62, 63, and plate portion 12, are preferably formed as a single molded plastic part to form an integral carrier. A locking pin 64 extends along the plug axis 100 and lies between the tongues. A rear end of the pin lies in a recess 65, where it engages posts 66, 67 of slide elements 68, 69 that slide on the case shells. When the locking pin 64 moves forward, it prevents the tongues from moving together, to lock them in an IC card undercut latch-receiving opening 78 (FIG. 1B).

FIG. 1B shows that the IC card 50 has a sheet metal cover 51 which provides EMI shielding. The cover 51 has two sheet metal cover halves 52, 53 which are fixed together in a manner not shown. The rear end of the IC card has a rear connector 120 with a dielectric connector housing 54 lying between the two cover halves 52, 53. The particular card shown also has a rear plate 59 with holes aligned with those of the rear connector 120. The rear connector has plug-receiving openings 55, 56 for receiving the plug parts 13, 14 of the cable plug. This allows socket contacts of the plug to mate to pin contacts on the IC card rear connector. The plate 59 has notches 57, 58 lying respectively above and below each plug-receiving opening 55, 56, for receiving the grounding tabs 43, 45 of the plug.

FIGS. 3 and 4 show that the top and bottom sheet-like cover portions 130, 132 of the IC card cover 51, each have depressions 71, 72. The depressions lie at locations corresponding to the notches 57, 58 on the front plate 59. The bottom 73 of each top depression 71 extends slightly above the lower edge 75 of each notch 57, and the depression includes an inclined lead-in 74. The bottom depression 72 and notches 58 are correspondingly constructed.

When the cable plug mates with the connector at the rear of the IC card, as shown in FIG. 4, the tabs 43, 44 connect to the IC card top and bottom cover portions 130, 132. The tabs 43, 44 pass through the notches 57, 58 in the rear plate 58 of the card, and into the depressions 71, 72, with the tabs resting on the depression bottoms 73. The tabs thereby make contact with the cover halves 52, 53 of the IC card cover. This arrangement results in an electrical connection between the cable shield 24 and the IC card cover, through each of the plug case shells. The plug case shells provide parallel connections between the cable shield end IC card cover for greater reliability.

It may be noted that the cable plug as shown in FIG. 1A, is symmetrical about a vertical plane 140 and about a horizontal plane 142, each plane passing through the plug axis 100. Although terms such as vertical, horizontal, top, bottom, etc. have been used in describing the invention, the invention can be used in any orientation with respect to Earth's gravity.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A shielded cable plug for attachment to a cable that has a cable shield, and for mating with the rear end of an IC card that has a laterally-extending width and that has a vertically-extending height which is less than half of said width, and that has a rear end with a central latch-receiving opening (78) and that has a pair of contact-receiving openings (55, 56) lying on laterally opposite sides of said latch-receiving opening, and wherein said IC card has a sheet metal top cover portion (130), comprising:

a dielectric cable plug carrier (11) which has a laterally-extending plate portion (12), a latch portion that projects forward of said plate portion and that can project into said latch-receiving opening (78) of said card, and a pair of contact-holding plug parts (13, 14) that project forward of said plate portion and can be inserted into said contact-receiving openings of said card;

a sheet metal shield case (30) which lies primarily rearward of said plate portion and that has a case rear portion that is electrically connectable to said cable shield;

said plate portion having a first slit (45), and said sheet metal case has a first tab (43) projecting forwardly through and forwardly beyond said slit to engage said card top cover portion.

2. The plug described in claim 1 wherein:

said plate portion has a plurality of slits including said first slit, and said case has a plurality of tabs including said first tab that each projects forwardly through and beyond one of said slits, with each of said slits having slit walls that each completely surround one of said tabs.

3. The plug described in claim 1 wherein:

said sheet metal shield case has upper and lower case shells, with said lower case shell forming at least part of said case rear portion, and with said lower case shell having a rear portion forming a pair of upstanding fingers, said fingers being laterally spaced to closely receive said cable shield between them and being bendable to crimp to said cable shield.

4. The plug described in claim 3 wherein:

said upper case shell has a rear portion with a rearwardly-extending projection forming a bridge (40), and said upstanding fingers extend high enough to crimp around said bridge when crimping around the cable shield.

5. The plug described in claim 1 wherein:

said sheet metal case has upper and lower case shells, with each of said case shells having a plate portion with laterally opposite sides, said lower case shell having upstanding sides at its plate portion opposite sides and said upper case shell having downwardly-extending sides at its plate portion opposite sides, with said upstanding sides and said downwardly-extending sides overlapping at opposite sides of said case.

6. The plug described in claim 1 wherein:

said carrier plate portion has a substantially rectangular periphery; and including a protective plug cover which has a rear end with a cable-passing passage and an open front end that lies substantially even with said carrier plate portion and that abuts said carrier plate portion and that extends along substantially the entire periphery of said carrier plate portion.

7. A combination of a shielded cable plug for attachment to a cable that has a cable shield, and an IC card, where said cable plug and said card each has a laterally-extending width and has a vertically-extending height which is less than half of the width, wherein said card has a top sheet metal cover portion and has a rear end with a rear dielectric connector housing lying under said sheet metal top cover portion, said dielectric connector housing having a pair of laterally-spaced plug-receiving openings and said plug has a dielectric carrier with a laterally-extending plate portion and with a pair of contact-holding plug parts that project forwardly from said plate portion into said plug-receiving opening of said card, wherein:

said cable plug has a sheet metal shield case with a rear case portion that is electrically connectable to said cable shield, said sheet metal shield case lying primarily rearward of said carrier plate portion but having a forwardly projecting tab that projects forward of said carrier plate portion and that engages said top sheet metal cover portion.

8. The combination described in claim 7 wherein:

said top sheet metal cover portion has a depression with a cover depression part at the rear of said card;

said tab lies in said depression and on top and against said cover depression part.

9. A shielded cable plug for attachment to a cable that has a cable shield, and for mating with the rear end of an IC card, comprising:

a contact-holding dielectric cable plug carrier which has a laterally-extending carrier plate portion;

a sheet metal shield case which lies primarily rearward of said plate portion, said shield case having upper and lower case shells, with said lower case shell having a rear portion;

said rear portion of said lower case shell forming a pair of upstanding fingers that are integral with the rest of said lower case shell, said fingers being horizontally spaced to closely receive said cable shield between them;

said upper case half having a rear portion with a rearwardly-extending projection forming a bridge that lies largely above and between said fingers, with said fingers being tall enough to crimp around said bridge when crimping around said cable shield.

* * * * *